US006196034B1

(12) United States Patent
Diebold et al.

(10) Patent No.: US 6,196,034 B1
(45) Date of Patent: Mar. 6, 2001

(54) TAMPER-RESISTANT LATCH ASSEMBLY FOR SLIDABLE PARTITIONS

(75) Inventors: Stephen E. Diebold; H. Neil Lukenbill, both of Louisville, KY (US)

(73) Assignee: Wirecrafters, Inc., Louisville, KY (US)

( * ) Notice: Subject to any disclaimer, the term of this patent is extended or adjusted under 35 U.S.C. 154(b) by 0 days.

(21) Appl. No.: 09/378,826

(22) Filed: Aug. 23, 1999

Related U.S. Application Data

(63) Continuation-in-part of application No. 09/287,911, filed on Apr. 7, 1999.

(51) Int. Cl.[7] ..... E05B 65/08
(52) U.S. Cl. ..... 70/95; 292/DIG. 46
(58) Field of Search ..... 70/95–100, 139; 292/DIG. 46

(56) References Cited

U.S. PATENT DOCUMENTS

| | | | | |
|---|---|---|---|---|
| 2,370,781 | | 3/1945 | Cullum | 292/346 |
| 2,638,370 | * | 5/1953 | Price | 70/97 |
| 2,698,196 | * | 12/1954 | Mangus | 70/97 |
| 2,749,164 | * | 6/1956 | Kitzelman | 70/139 |
| 2,862,378 | | 12/1958 | Harris | 70/95 |
| 3,012,430 | | 12/1961 | Spork | 70/99 |
| 3,050,322 | | 8/1962 | Miller | 292/114 |
| 3,103,805 | | 9/1963 | Crosswell | 70/142 |
| 4,005,890 | | 2/1977 | Murch | 292/346 |
| 4,024,739 | | 5/1977 | Kaufman | 70/97 |
| 4,170,885 | * | 10/1979 | Lundgren | 70/99 |
| 4,438,641 | * | 3/1984 | Levkov | 70/95 |
| 4,599,875 | * | 7/1986 | DeForrest | 70/95 |
| 4,790,157 | | 12/1988 | Lin | 70/95 |
| 4,865,370 | | 9/1989 | Francis | 292/340 |
| 5,356,185 | | 10/1994 | Cameron | 292/149 |
| 5,382,060 | | 1/1995 | O'Toole et al. | 292/46 |
| 5,388,875 | | 2/1995 | Fleming | 292/37 |
| 5,586,796 | | 12/1996 | Fraser | 292/346 |
| 5,595,409 | * | 1/1997 | Fiek et al. | 292/DIG. 46 |
| 5,664,445 | | 9/1997 | Chang | 70/34 |
| 5,816,629 | | 10/1998 | Donald | 292/254 |

OTHER PUBLICATIONS

Multilock Product Literature (1968), 9 pages.
Wireway Husky Product Literature (1996), 1 page.
"Sliding Door Lock Receiver Cylinder Lock with Insert", WireCrafters, 1 page.

* cited by examiner

*Primary Examiner*—Darnell Boucher
(74) *Attorney, Agent, or Firm*—Wood, Herron & Evans, L.L.P.

(57) ABSTRACT

A latch assembly incorporates a pair of overlapping tubular guard projections respectively secured to a pair of opposing structural members, at least one of which is disposed on a slidable partition. As the projections are tubular, the projections isolate the enclosed area within the projections from all sides. Moreover, as one projection overlaps the other, no gaps are present that could otherwise permit access to the enclosed area within the projections. As such, whenever a latch member projects through the enclosed area within the overlapping projections, the latch member is substantially protected from unauthorized tampering.

28 Claims, 4 Drawing Sheets

TAMPER-RESISTANT LATCH ASSEMBLY FOR SLIDABLE PARTITIONS

CROSS-REFERENCE TO RELATED APPLICATIONS

This application is a continuation-in-part of U.S. patent application Ser. No. 09/287,911, filed by Diebold et al. on Apr. 7, 1999, which application is incorporated by reference herein.

FIELD OF THE INVENTION

The invention is generally related to latches and latch assemblies, and in particular to latches and latch assemblies for use with slidable partitions such as doors and gates.

BACKGROUND OF THE INVENTION

Latch assemblies, or latches, are commonly used to engage movable partitions such as doors or gates with other structural members, e.g., posts, walls, or panels, or other doors or gates. One use of a latch, for example, is in connection with a slidable partition such as a sliding gate.

A predominant use of a slidable partition is in selectively providing access to an enclosed or secured area To this extent, oftentimes a lock is used in connection with a latch on a slidable partition to prevent the slidable partition from being opened by an unauthorized party. However, many latch and lock designs are susceptible to tampering, which may enable an unauthorized party to defeat a latch and/or lock to gain entry through the slidable partition.

For example, a number of sliding gate designs engage with a structural member (e.g., a fixed post or other partition) using a locking mechanism that operates a latch member to engage with a cooperative keeper on the structural member. The latch member typically projects outwardly from an end surface of the sliding gate in the direction of movement of the sliding gate. The locking mechanism is capable of moving the latch member between an unlocked position, where the latch member does not engage with the keeper, and a locked position, where the latch member engages with the keeper to prevent the sliding gate from disengaging from the structural member. Moreover, oftentimes the latch member is spring-loaded such that, when the locking mechanism is locked, but the sliding gate has not yet been moved to its closed position, the latch member deflects from its locked position to its unlocked position as the sliding gate is closed, and then springs back to the locked position once the sliding gate is moved to the fully closed position. Opening of the sliding gate requires actuation of the locking mechanism to move the latch member from the locked to the unlocked position.

While a spring-loaded latch member simplifies the operation of a sliding gate, such a latch member also often facilitates tampering by unauthorized parties. Specifically, oftentimes it is possible to access the latch member even when the sliding gate is closed, possibly permitting the latch member to be manually deflected to its unlocked position independent of the locking mechanism. For this reason, a significant amount of effort has been expended in the area of protecting a spring-loaded latch member from unauthorized tampering.

Conventional designs typically incorporate various guards to prevent external access to a spring-loaded latch, typically including cooperative members having opposing recesses and projections that serve to restrict external access to one or more sides of a latch. A number of designs do not, however, restrict access to all sides of a latch, and thus present a relatively greater security risk. Other designs that do restrict access to all sides of a latch are typically constructed of somewhat complicated interlocking members, which are more difficult and costly to manufacture. Further, in some designs the interlocking members may still provide gaps that an enterprising party may be able to exploit to gain unauthorized access through the gate. Moreover, many conventional designs are difficult to install or retrofit on existing structures.

Therefore, a significant need continues to exist for an improved mechanism for restricting access to a latch for a slidable partition such as a sliding gate, particularly for a mechanism that is less expensive and complicated, and more secure, than conventional designs.

SUMMARY OF THE INVENTION

The invention addresses these and other problems associated with the prior art by providing a latch assembly that incorporates a pair of overlapping tubular guard projections respectively secured to a pair of opposing structural members, at least one of which is disposed on a slidable partition. As the projections are tubular, the projections isolate the enclosed area within the projections from all sides. Moreover, as one projection overlaps the other, no gaps are present that could otherwise permit access to the enclosed area within the projections. As such, whenever a latch member projects through the enclosed area within the overlapping projections, the latch member is substantially protected from unauthorized tampering.

Typically, one of the overlapping tubular guard projections is secured to the end surface of one of the structural members, while the other projection is secured to a base plate of a keeper secured to the other structural member. Each projection extends generally along an engagement axis along which the slidable partition slides, with the projection coupled to the end surface circumscribing a latch member receiving aperture in the end surface. Both the end surface and the base plate oppose one another and extend perpendicular to the engagement axis.

Furthermore, in some embodiments, the opposing projections have generally the same length along the engagement axis such that, when the structural members are secured to one another, the opposing projections overlap generally throughout an exposed region between the base plate and the end surface. As such, the enclosed area is protected on all sides by two layers substantially throughout the exposed region. In addition, in some embodiments, the overlapping tubular guard projections are suitable for retrofitting an existing latch assembly for use in securing a sliding gate to a fixed structural member, simply through mounting a first tubular guard projection to the end surface of the sliding gate, with the projection circumscribing a latch member receiving aperture, and mounting a keeper including a second tubular guard projection to the fixed structural member. In still other embodiments, a projection may be used to house a padlock adaptor that replaces a latch member and projects through the latch member receiving aperture to permit a padlock to be used to lock the slidable partition in lieu of a lock assembly.

In still other embodiments, the length of the base plate of the keeper is selected to provide a minimum separation of at least about 4⅜ inches between a lock release on a lock assembly to each of the longitudinally opposing edges of the keeper (such longitudinally opposing edges being defined in a direction generally transverse to the engagement axis). By doing so, the lock release is protected from unauthorized attempts to reach the lock release through any gap between the first and second structural members.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described exemplary embodiments of the invention.

DETAILED DESCRIPTION

Figure 1:
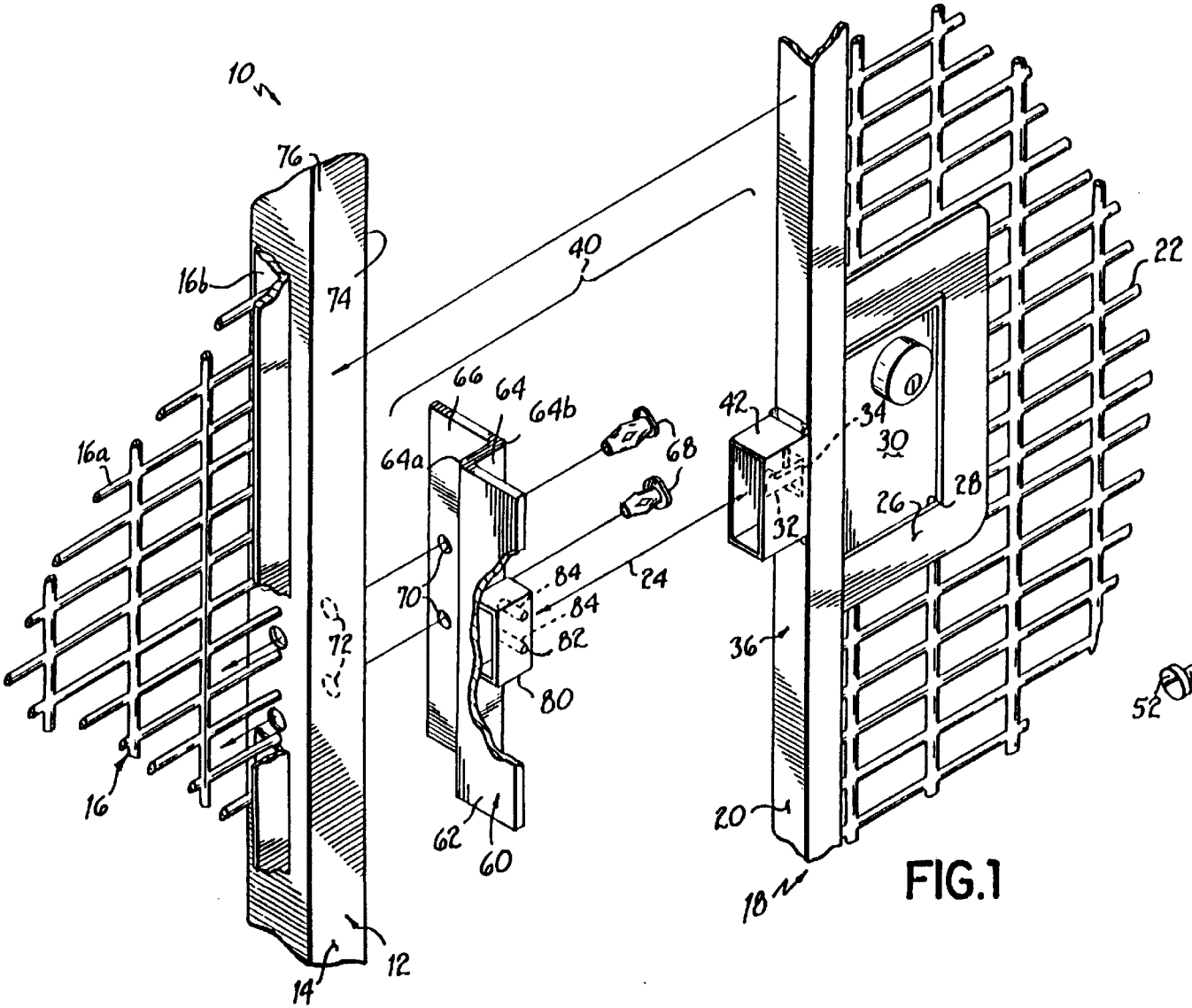
FIG. 1 is an exploded fragmentary perspective view of an enclosure consistent with the invention, with portions of a latch assembly used therein cut away.

Turning to the Drawings, wherein like numbers denote like parts throughout the several views, FIG. 1 illustrates an enclosure 10 consistent with the invention. Enclosure 10 includes a fixed partition 12 including a tubular post 14 and a wire mesh panel 16, and a slidable partition 18 defined by a wire mesh panel including an angle frame 20 and wire mesh 22. Each of partitions 12, 18 in the illustrated embodiment are constructed from woven wire mesh partitions, e.g., the #840 style partitions available from WIRECRAFTERS, Inc. of Louisville, Ky., the assignee of the present invention.

In the illustrative embodiment, wire mesh panel 16 includes wire mesh 16*a* framed by a 1¼"×1¼"×3⁄16" steel angle frame 16*b*. In addition, panel 16 is bolted to post 14 through angle frame 16*b* using ⅜–16×3" bolts (not shown). Likewise, 1¼"×1¼"×3⁄16" steel angle is used for angle frame 20.

Slidable partition 18 is a sliding gate that is slidable along an engagement axis represented at 24. The sliding gate includes a lock mounting plate 26 having a lock assembly receiving aperture 28 within which is mounted a lock assembly 30. Lock assembly 30 is typically a mortise cylinder lock, which includes a hooked latch member 32 that projects through a latch member receiving aperture 34 formed in an end face 36 of angle frame 20. Lock assembly 30 is, for example, a No. W3830 mortise cylinder lock available from Marks Lock Co.

Partition 12 is typically secured at a fixed position, e.g., so that post 14 forms a fixed post relative to which the sliding gate 18 moves along the engagement axis. However, it should be appreciated that partition 12 may also be slidable as well. Moreover, rather than a partition, a slidable partition may engage with any other suitable structural members as is known in the art. Further, it should be appreciated that the lock assembly and associated hooked latch member may be disposed on partition 12 or other suitable structure, rather than on sliding gate 18.

In general, it should be appreciated that the principles of the invention may be utilized to secure any pair of structural members together, where one of the structural members is disposed on a slidable partition. Other types of slidable partitions for which the invention may be utilized include other forms of sliding gates, slidable doors, slide up gates, etc. It will be appreciated that the embodiment described herein is but one suitable embodiment, and the invention should therefore not be limited solely to that which is specifically disclosed herein.

A latch assembly 40 is used to secure slidable partition 18 to post 14 of partition 12. Latch assembly 40 includes a first tubular guard projection 42 that fully circumscribes the latch member receiving aperture 34 in end face 36 of frame 20.

Figure 2:
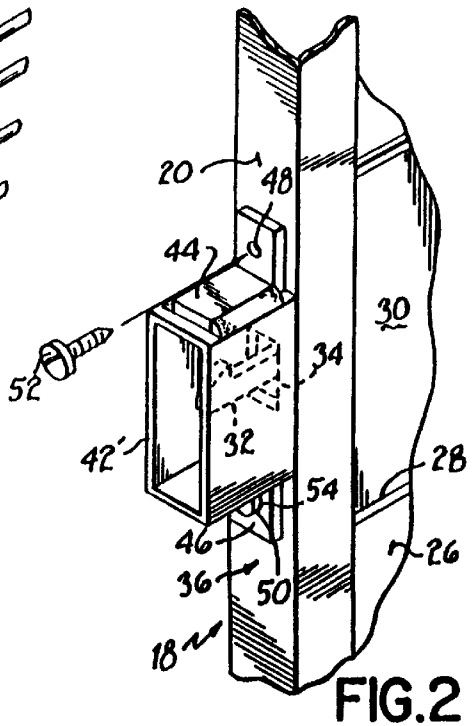
FIG. 2 is a perspective view of an alternate tubular guard projection secured to the sliding gate of FIG. 1.

Projection 42 is illustrated in FIG. 1 as being welded to end face 36. However, it should be appreciated that other manners of securing projection 42 to structural member 20 may be used in the alternative. For example, as illustrated in FIG. 2, a tubular guard projection 42' may include one or more mounting flanges, e.g., flanges 44, 46, which include apertures 48, 50 through which threaded fasteners 52, 54 are received to secure projection 42' to the end face 36 of angle frame 20. The mounting flanges are welded to the top and bottom sides of the tubular projection. As discussed in greater detail below, such an alternate attachment mechanism may be useful in facilitating the retrofitting of existing sliding gates. Other attachment mechanisms may also be used in the alternative.

Returning to FIG. 1, latch assembly 40 also includes a keeper 60 mounted to post 14 of partition 12. Keeper 60 includes a base plate 62, a transverse plate 64 and a mounting plate 66. Keeper 60 is secured to structural member 14 via one or more fasteners, e.g., Plusnut fasteners 68 projecting through mounting apertures 70 in mounting plate 66 and apertures 72 in an end face 74 of post 14. Other types of fasteners, as well as other manners of securing keeper 60 to the structural member, may be used in the alternative.

When installed, base plate 62 of keeper 60 extends generally perpendicular to engagement axis 24. Transverse plate 64 includes first and second opposing edges 64*a*, 64*b*, with the transverse plate joined to the base plate along edge 64*a* and extending generally perpendicular to the base plate, and in a direction toward the slidable partition 18. Mounting plate 66 is coupled to edge 64*b* of transverse plate 64, extending parallel to, but in an opposite direction from, base plate 62. Thus, when keeper 60 is mounted to post 14, mounting plate 66 substantially overlies end face 74 of post 14, while transverse plate 64 substantially overlies a side face 76 of the post. It should be appreciated, however, that when mounting to alternate structural members, an alternate configuration for keeper 60 may be used in the alternative.

Mounted to base plate 62 of keeper 60 is a second tubular guard projection 80, which projects outwardly from the base plate along the general direction of engagement axis 24. Projection 80 is oriented to directly oppose projection 42 mounted to angle frame 20.

In addition to providing a support for projection 80, base plate 62 provides additional tamper resistance by virtue of its extending a substantial distance both above and below projection 80. As such, access to projection 80 through the wire mesh panel 16 is made more difficult by virtue of the configuration of base plate 62. The length of base plate 62, as well as that of transverse plate 64 and mounting plate 66 may vary for different embodiments, with relatively longer lengths providing added protection. Moreover, in the illustrated embodiment, plates 62, 64 and 66 are formed from a single piece of sheet metal, e.g., #10 sheet metal, and bent along two edges to form the respective plates. In other embodiments, alternate constructions of the plates may be used.

Projections 42, 80 are each typically formed of tubular material, e.g., #14 sheet metal formed into a tubular construction and welded along a seam. Other materials and constructions may be used in the alternative, e.g., formed flat steel, round steel, or plastic pipe, among others.

Figure 3:
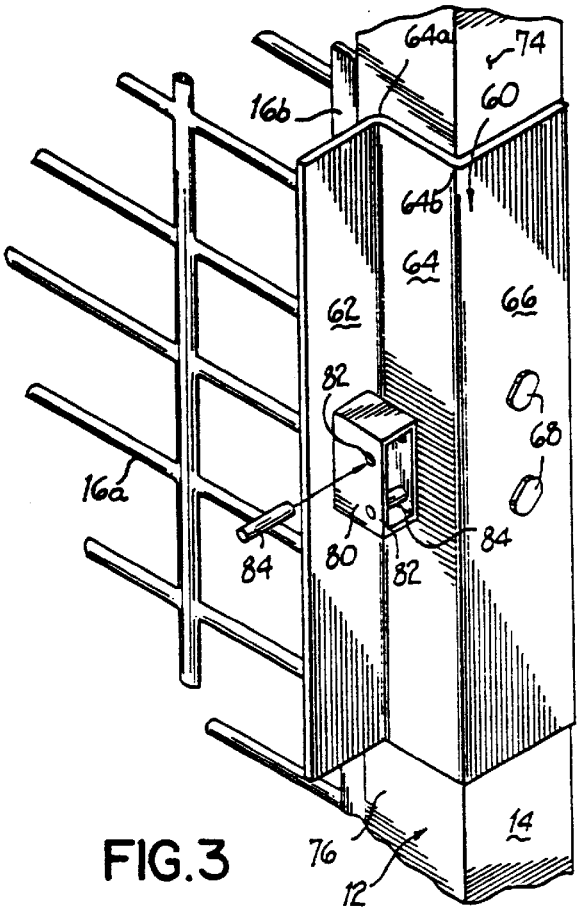
FIG. 3 is a perspective view of the keeper in the latch assembly of FIG. 1, shown installed on a fixed post.

Projection 80 is utilized to at least partially enclose a catch mechanism that engages hooked latch member 32 on slidable partition 18. As best shown in FIG. 3, for example, projection 80 may include one or more pairs of mounting apertures 82 within which are mounted one or more spring pins 84 that extend across the width of the projection, and in a direction generally perpendicular to engagement axis 24.

As will be discussed in greater detail below, only one such pin 84 is required to engage with the hooked latch member 32. However, in some embodiments it may be desirable to provide a pair of pins disposed roughly equidistant from a horizontal center line that vertically bisects the projection so that keeper 60 may be installed in either an upright or an inverted orientation to accommodate sliding gates that overlap partition 12 on either of inside or outside sides thereof. Moreover, it should be appreciated that other catch mechanisms may be utilized to engage hooked latch member 32 in the alternative, e.g. flanges or tabs on the projection itself, among others.

Figure 5:
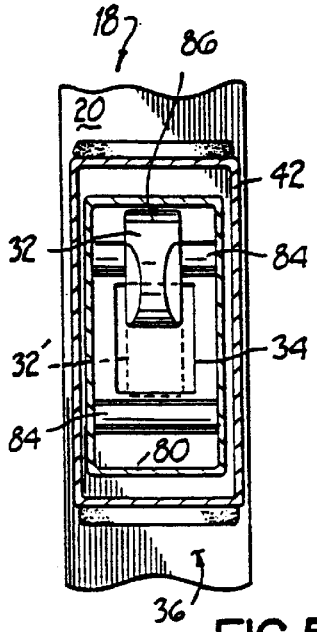
FIG. 5 is a cross-sectional view taken through lines 5—5 of FIG. 4.
Figure 4:
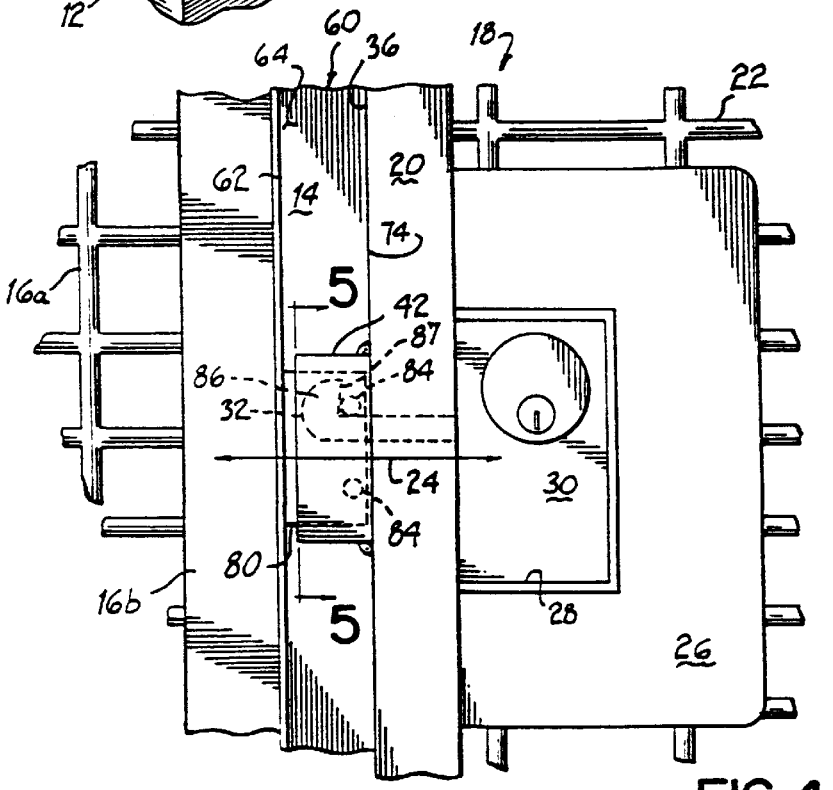
FIG. 4 is a fragmentary side elevational view of the enclosure of FIG. 1, showing the sliding gate thereof disposed in a closed position relative to the fixed post.

With the configuration of projection 42 and projection 80 respectively mounted to angle frame 20 and post 14, the projections are configured to substantially overlap one another when slidable partition 18 is moved to a closed position immediately adjacent partition 12. For example, as illustrated in FIG. 4, slidable partition 18 is illustrated in a closed position, where hooked latch member 32 has been inserted into keeper 60 to engage with one of pins 84 forming the catch mechanism. Specifically, as best illustrated in FIG. 5, when slidable partition 18 is moved toward partition 12 along the engagement axis, a cammed surface 86 of hooked latch member 32 engages pin 84 and deflects to the position illustrated at 32'. Once the cammed surface 86 passes pin 84, however, the spring bias on hooked latch member 32 causes the hooked latch member to return to the locked position illustrated at 32 in FIG. 5. As shown in FIG. 4, an engagement surface 87 on the hooked latch member engages pin 84, thus securing angle frame 20 and slidable partition 18, to post 14.

In addition, it may be seen from FIG. 5 that projections 42, 80 are provided with cooperating cross-sections that generally provide a telescoping arrangement between the projections when the slidable partition is closed. Specifically, the cross-sectional shapes of the respective projections 42, 80 have corresponding perimeters such that a relatively tight fit between the projections is provided when one projection overlaps the other. In the illustrated embodiment, each projection 42, 80 includes a generally rectangular cross-section, although other shapes, e.g., other polygonal cross-sections, or a circular or elliptical cross-section, may also be used in the alternative.

Also, the respective projections 42, 80 may be sized relative to one another to provide different relative gaps therebetween. FIG. 5, for example, illustrates an embodiment where a relatively small gap (e.g., about 0.042" on each side) is provided between the left and right sides of each projection 42, 80, with a relatively larger gap (e.g., about 0.167" on each side) between the top and bottom sides thereof to accommodate any sagging or misalignment between the slidable partition and the fixed post. It should be appreciated that any degree of tolerance between the respective sides of the projections may be provided consistent with the invention, with smaller gaps providing greater security and tamper resistance, and with larger gaps facilitating closing of the slidable partition.

Returning to FIG. 4, it can also be seen that the respective lengths of each projection 42, 80 along the engagement axis 24 may be generally the same (e.g., within about 80% of one another) such that the projections overlap substantially along the entire exposed region between base plate 62 of keeper 60 and end face 36 of structural member 20. As such, the base plate 62 and end face 36 may cooperate with the respective end surfaces of projections 42, 80 to further inhibit access to the enclosed area within projections 42, 80. In the alternative, various degrees of overlap may be provided, albeit with less resistance to tampering.

Various modifications may be made to the illustrated embodiments without departing from the spirit and scope of the invention. For example, the latch member, and thus the latch member receiving aperture around which a projection circumscribes, may be disposed on either the slidable partition or on the other structural member to which the slidable partition is secured. Moreover, base plate 62 of keeper 60 may be formed integrally with the structural member 14 of partition 12. Moreover, one or both of transverse plates 64 in mounting plate 66 may be omitted in some embodiments.

Also, while projection 42 is illustrated as being larger than and overlapping projection 80, it should be appreciated that the projection within which is enclosed the catch mechanism may instead overlap the projection that circumscribes the latch member receiving aperture. Moreover, in other embodiments, a third projection may circumscribe projection 80 to provide additional protection, with projection 42 fitting within a recess defined between projection 80 and the additional projection circumscribing the same.

Figure 6:
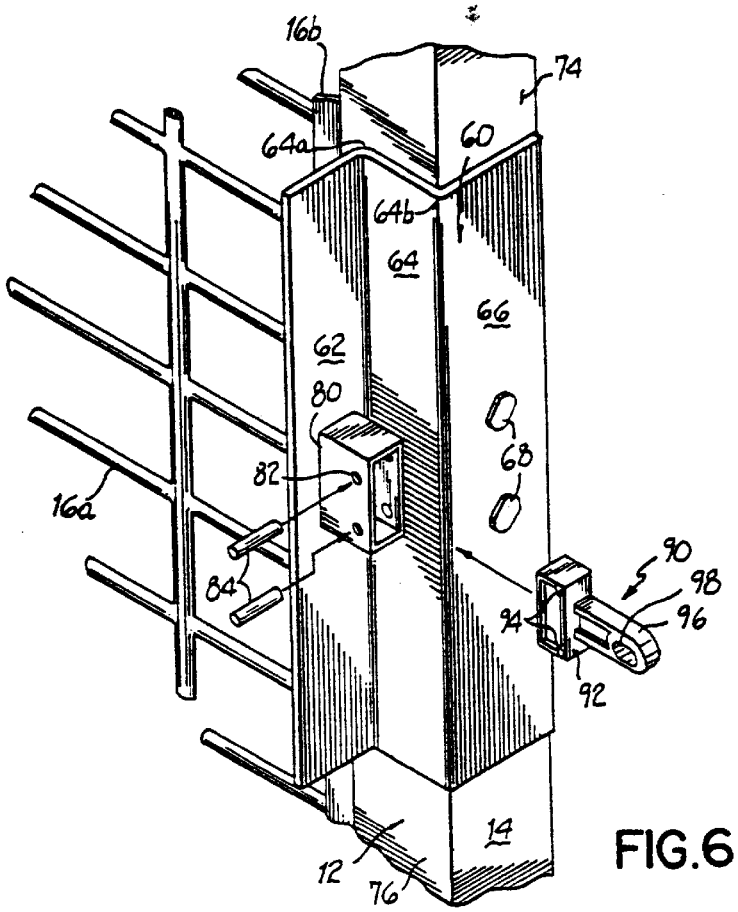
FIG. 6 is a perspective view of the keeper in the latch assembly of FIG. 1, showing the installation of a padlock adaptor thereon.
Figure 7:
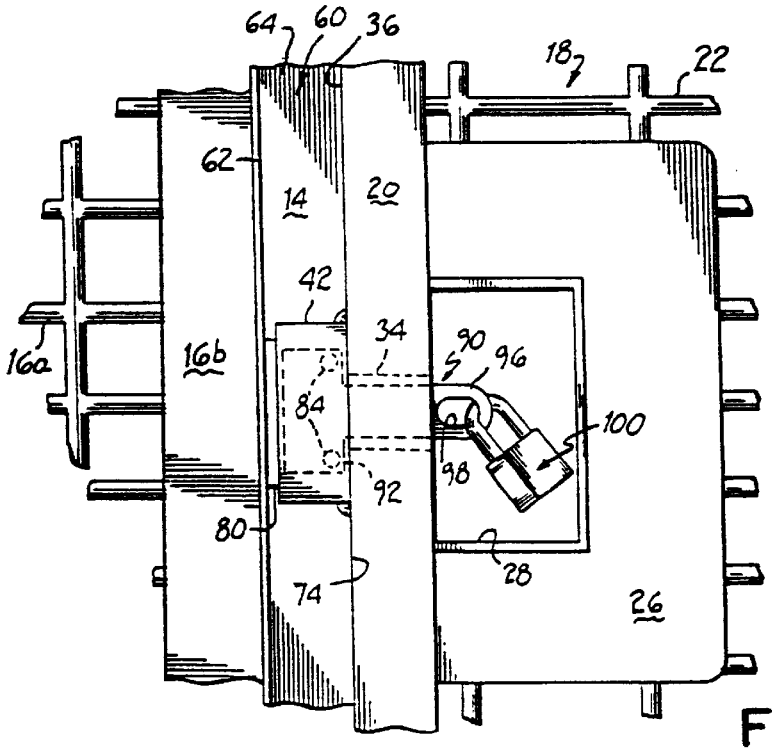
FIG. 7 is a fragmentary side elevational view of the enclosure of FIG. 1, illustrating the use of the padlock adaptor of FIG. 6 for securing the sliding gate to the fixed post without a separate lock assembly.

The configuration of latch assembly 40 shown in FIGS. 1–5 has an additional feature that increases the flexibility of the assembly. Specifically, as illustrated in FIG. 6, it may be desirable in some implementations to mount within projection 80 a padlock adaptor 90 including a base portion 92 that is received within projection 80, and secured thereto by extending pins 84 through a pair of mounting apertures 94 provided in the base portion. Projecting from base portion 92 is a tongue portion 96 having an eye or aperture 98 disposed at a distal end thereof. As shown, for example, in FIG. 7, padlock adaptor 90 is suited for use in implementations where no lock assembly is provided in lock assembly receiving aperture 28 of lock mounting plate 26. Thus, rather than utilizing a hooked latch member as described above in connection with FIGS. 1–5, tongue portion 96 of padlock adaptor 90 instead projects through latch member receiving aperture 34 and into lock assembly receiving aperture 28. To secure slidable partition 18 to partition 12, therefore, a padlock 100 or other like locking mechanism may be mounted through eye 98 to prevent retraction of the padlock adaptor tongue portion from aperture 34, and thus resist separation of slidable partition 18 relative to partition 12.

Padlock adaptor 90 may be constructed of a low cost yet suitably strong material, e.g., steel, and provided to a customer along with latch assembly 40 such that, should the customer not desire to use a lock assembly in the slidable partition, the simple and inexpensive modification via padlock adaptor 90 may be substituted with little or no additional cost and effort.

As another alternative, it may be desirable to include a stop on each of the slidable partition and the opposing structural member to limit the travel of the slidable partition. Also, a guide mechanism may also be used on the slidable partition to assist in centering the guard projections relative to one another.

In use, the latch assembly described herein may be installed on new enclosures, or may be retrofitted onto existing enclosures. Typically, such a retrofit only requires that any existing keeper be removed, a new keeper having a tubular guard projection be installed in its place, and a cooperative tubular guard projection installed over the existing latch member receiving aperture. Furthermore, when the tubular guard projection 42' of FIG. 2 is used, a retrofit operation is even simpler in that easily installed screws or other fasteners may be used to mount the projection over the existing latch member receiving aperture.

Figure 8:
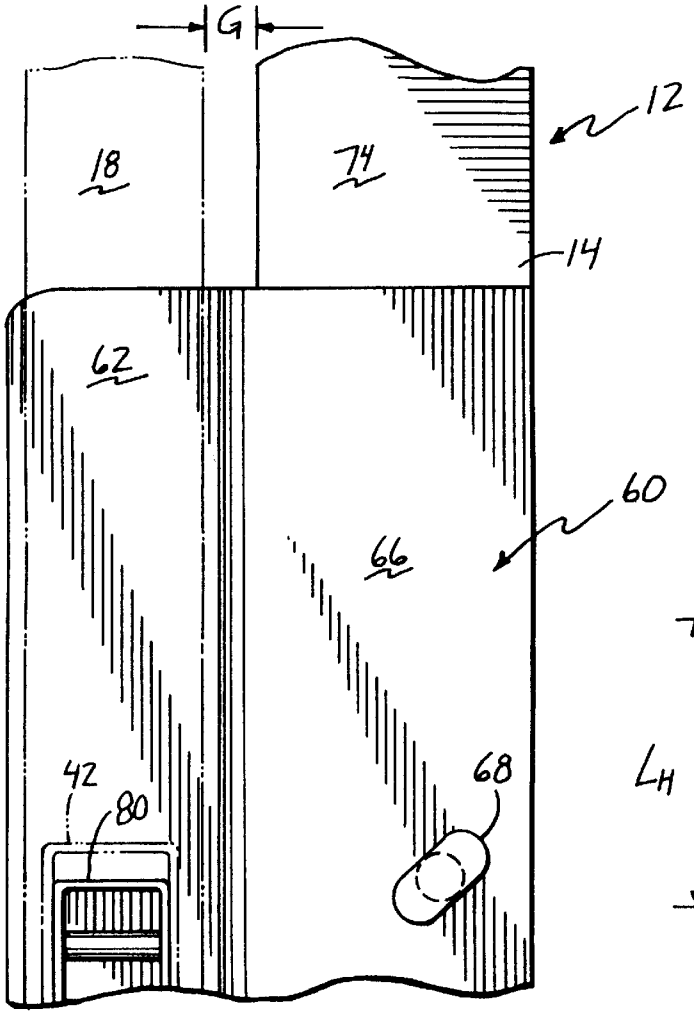
FIG. 8 is a fragmentary end elevational view of the enclosure of FIG. 1, illustrating the gap present between the slidable and fixed partitions thereof.

As discussed above, an additional important protection feature of the embodiments of FIGS. 1–7 is the degree in which keeper 60 (at least base plate 62 and transverse plate 64) extends lengthwise in the direction from top to bottom of a slidable partition. In particular, it has been found that a natural gap (identified at "G" in FIG. 8) exists between slidable partition 18 and post 14 of partition 12. Of particular concern are outside-oriented sliding door installations in which a slidable partition is slidably hung from an overhead track through a trolley mechanism mounted to a top frame of the slidable partition. In many instances, the construction of a slidable partition such as a woven wire mesh panel requires that the mounting aperture in the partition frame be offset from the longitudinal centerline of the frame so that a nut can be used to secure a trolley mechanism to the frame. This offset increases the natural gap G as opposed to inside-oriented installations.

Figure 9:
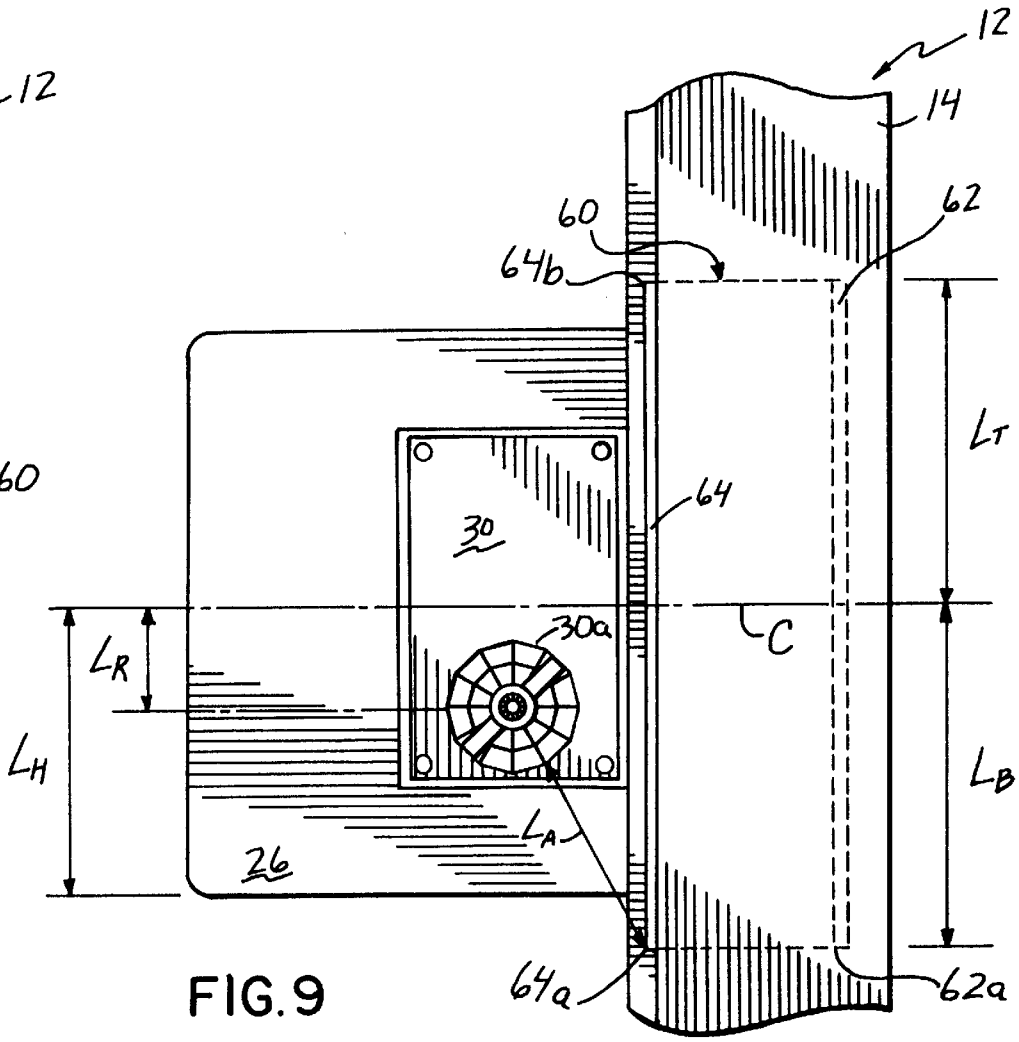
FIG. 9 is a fragmentary side elevational view of the interior side of the enclosure of FIG. 1.

It has been found that, absent additional protection provided by keeper 60, a person with small enough hands may be able to reach through gap G to release the lock assembly and thereby gain access through the slidable partition. For example, FIG. 9 illustrates the interior side of enclosure 10, with a user-manipulated lock release 30*a* disposed on an interior side of lock assembly 30. Lock release 30*a* is offset from a centerline C of lock assembly 30 by a distance labeled $L_R$, with lock mounting plate 26 forming a guard that extends a distance labeled $L_H$ from centerline C. The distances in which keeper 60 extends above and below centerline C are respectively labeled $L_T$ and $L_B$.

In the illustrated embodiment, for example, lock assembly 30 is a #104 wire partition lock available from Multi Lock Inc. of Ft. Lauderdale, Fla. The #104 lock has a length of approximately 6⅜ inches, with a lock release offset $L_R$ of approximately 1 13/16 inches. The lock mounting plate has a length of approximately 10 inches, providing an offset $L_H$ of about 5 inches. It has been found, for example, that utilizing a keeper 60 with a length of only about 4 inches (and centered to provide distances $L_T$ and $L_B$ of about 2 inches each) may permit the lock to be compromised through access through gap G (FIG. 8), as it may be possible to reach through the gap from underneath the bottom edge of keeper 60 and manipulate lock release 30*a*.

To prevent this mode of access, it is desirable instead to provide keeper 60 with a length $L_B$ that provides enough separation (typically exceeding the typical length of a human finger) between the respective closest points on bottom edge 64*a* of the keeper and lock release 30*a*, labeled as $L_A$ (and also referred to herein as the minimum separation). In particular, it is preferable to provide keeper 60 with a length sufficient to provide a minimum separation $L_A$ of at least about 4⅜ inches, and more preferably at least about 5 inches. One configuration that satisfies this condition with the aforementioned #104 lock is a keeper having a dimension $L_B$ of about 6 inches. In addition, given that keeper 60 may be installed in an upside-down configuration in other installations, it is also desirable (but not required) to provide a cooperative dimension $L_T$ of about 6 inches as well, providing an overall length of about 12 inches. Otherwise, in other implementations the dimension $L_T$ may similarly be selected to provide at least the minimum separation noted above between the respective closest points on top edge 64*b* of the keeper and lock release 30*a*.

It will be appreciated, however, that the particular dimensions of keeper 60 that are required to prevent the above-described mode of access may vary significantly depending upon the sizes, placements and shapes of the lock and lock release therefor, as well as the particular configuration of the lock and the lock release (e.g., whether a handle projects outwardly from the lock release, or is recessed into the lock as shown in FIG. 9). In particular, different types and brands of locks may vary widely in dimensions and mechanisms of release, and selection of the dimensions of keeper 60 to maintain the minimum separations from both the top and bottom edges of the keeper would be made in view of the particular lock configuration with which the keeper is to be used.

It will also be appreciated that, depending upon the particular configuration of keeper 60, it may only be necessary for only a portion of the keeper (that upon which is disposed the closest point on the top or bottom edge of the keeper to the lock release) to have a length sufficient to maintain the necessary minimum separation(s). For example, in some implementations, it may only be necessary for base plate 62 to have the requisite length, thus providing top and bottom edges (which oppose one another in a longitudinal direction generally transverse to the axis of engagement) separated by the requisite minimum separations.

Other modifications may be made consistent with the invention. Therefore, the invention lies in the claims hereinafter appended.

What is claimed is:

1. An assembly for use in securing a first structural member to a second structural member, wherein one of the first and second structural members is disposed on a slidable partition configured to slide relative to the other structural member along an engagement axis, and the first structural member including a latch member receiving aperture defined in an end surface thereof, the assembly comprising:

(a) a first tubular guard projection configured to be secured to the end surface of the first structural member and to circumscribe the latch member receiving aperture, the first tubular guard projection configured to extend outwardly from the end surface substantially equidistantly around a perimeter of the first tubular guard projection and in a direction generally along the engagement axis when secured to the first structural member; and (b) a keeper configured to be secured to the second structural member, the keeper including:

(1) a base plate configured to extend generally perpendicular to the engagement axis when the keeper is secured to the second structural member; and (2) a second tubular guard projection secured to and extending from the base plate and configured to extend along the engagement axis when the keeper is secured to the second structural member, wherein the first and second tubular guard projections are sized and configured relative to one another to overlap along the engagement axis when the first structural member is secured to the second structural member.

2. The assembly of claim 1, further comprising a catch mechanism secured to the keeper and at least partially enclosed within the second tubular guard projection.

3. The assembly of claim 2, wherein the assembly is adapted to be secured to a first structural member that is disposed on the slidable partition, the assembly further comprising a lock assembly adapted to be secured to the slidable partition, the lock assembly including a latch member configured to engage the catch mechanism and adapted to extend through the latch member receiving aperture and the first tubular guard projection, and wherein the first tubular guard projection extends from the end surface farther than does the latch member.

4. The assembly of claim 2, wherein the catch mechanism includes first and second transverse pins extending across the second tubular guard projection in a direction generally perpendicular to the engagement axis.

5. The assembly of claim 2, further comprising a padlock adaptor configured to be secured within the second tubular guard projection and to project through the latch member receiving aperture in the first structural member, the padlock adaptor including an eye defined at a distal end thereof and configured to receive a padlock when the padlock adaptor projects through the latch member receiving aperture.

6. The assembly of claim 5, wherein the padlock adaptor includes:

(a) a base portion including a mounting aperture configured to receive a transverse pin extending across the second tubular guard projection in a direction generally perpendicular to the engagement axis; and (b) a tongue portion including the eye and configured to extend from the base portion along the engagement axis.

7. The assembly of claim 1, wherein the first tubular guard projection is configured to be welded to the end surface of the first structural member.

8. The assembly of claim 1, wherein the first tubular guard projection includes at least one mounting flange configured to receive a fastener that secures the first tubular guard projection to the end surface of the first structural member.

9. The assembly of claim 1, wherein the first and second tubular guard projections having cooperating cross-sections.

10. The assembly of claim 9, wherein the first and second tubular guard projections are each rectangular in cross section.

11. The assembly of claim 1, wherein the first and second tubular guard projections have generally the same length along the engagement axis such that, when the first structural member is secured to the second structural member, the first and second tubular guard projections overlap generally throughout an exposed region between the base plate of the keeper and the end surface of the first structural member.

12. The assembly of claim 1, wherein the keeper further includes:

(a) a transverse plate having first and second opposing edges, the transverse plate coupled along the first edge to the base plate and extending generally perpendicular to the base plate in the same direction as the second tubular guard projection; and (b) a mounting plate coupled to the second edge of the transverse plate and extending parallel to and in an opposite direction as the base plate.

13. The assembly of claim 1, wherein the assembly is adapted to be secured to a first structural member that is disposed on the slidable partition, wherein the slidable partition comprises a sliding gate, and wherein the second structural member comprises a fixed post.

14. An apparatus, comprising:

(a) a first structural member and a second structural member, wherein at least one of the first and second structural members is disposed on a slidable partition configured to slide relative to the other structural member along an engagement axis, and the first structural member including a latch member receiving aperture defined in an end surface thereof;

(b) a first tubular guard projection secured to the end surface of the first structural member and circumscribing the latch member receiving aperture, the first tubular guard projection extending outwardly from the end surface substantially equidistantly around a perimeter of the first tubular guard projection and in a direction generally along the engagement axis; and (c) a keeper secured to the second structural member, the keeper including:

(1) a base plate extending generally perpendicular to the engagement axis; and (2) a second tubular guard projection secured to and extending from the base plate along the engagement axis, wherein the first and second tubular guard projections are sized and configured relative to one another to overlap along the engagement axis when the slidable partition is oriented in a closed position.

15. The apparatus of claim 14, wherein the first structural member is disposed on the slidable partition, the slidable partition including a lock assembly receiving aperture adjacent to the latch member receiving aperture and configured to receive a lock assembly, the apparatus further comprising a catch mechanism secured to the keeper and at least partially enclosed within the second tubular guard projection, the catch mechanism including first and second transverse pins extending across the second tubular guard projection in a direction generally perpendicular to the engagement axis.

16. The apparatus of claim 15, further comprising a lock assembly mounted within the lock assembly receiving aperture in the slidable partition, the lock assembly including a latch member projecting through the latch member receiving aperture and configured to engage at least one of the first and second transverse pins in the catch mechanism to secure the first structural member to the second structural member, wherein the first tubular guard projection extends from the end surface farther than does the latch member.

17. The apparatus of claim 15, wherein the catch mechanism includes a padlock adaptor having a base portion and a tongue portion, the base portion including first and second mounting apertures through which the first and second traverse pins respectively project, and the tongue portion including an eye configured to secure the first structural member to the second structural member by receiving a padlock when the tongue portion projects through the latch member receiving aperture and into the lock assembly receiving aperture in the slidable partition.

18. The apparatus of claim 14, wherein the first and second tubular guard projections having cooperating cross-sections.

19. The apparatus of claim 14, wherein the first and second tubular guard projections are each rectangular in cross-section.

20. The apparatus of claim 14, wherein the first and second tubular guard projections have generally the same length along the engagement axis such that, when the first structural member is secured to the second structural member, the first and second tubular guard projections overlap generally throughout an exposed region between the base plate of the keeper and the end surface of the first structural member.

21. The apparatus of claim 14, wherein the keeper further includes:

(a) a transverse plate having first and second opposing edges, the transverse plate coupled along the first edge to the base plate and extending generally perpendicular to the base plate in the same direction as the second tubular guard projection; and (b) a mounting plate coupled to the second edge of the transverse plate and extending parallel to and in an opposite direction as the base plate.

22. The apparatus of claim 14, wherein the first structural member is disposed on the slidable partition, wherein the slidable partition comprises a sliding gate, and wherein the second structural member comprises a fixed post.

23. An assembly for use in securing a sliding gate to a fixed structural member, wherein the sliding gate is configured to move along an engagement axis relative to the fixed structural member, and wherein the sliding gate includes a latch member receiving aperture defined in an end surface thereof, the assembly comprising:

(a) a first tubular guard projection being open at each end and configured to be secured to the end surface of the sliding gate and to circumscribe the latch member receiving aperture, the first tubular guard projection being rectangular in cross-section and configured to extend outwardly from the end surface and in a direction generally along the engagement axis when secured to the sliding gate; and (b) a keeper configured to be secured to the fixed structural member, the keeper including:

(1) a base plate configured to extend generally perpendicular to the engagement axis when the keeper is secured to the fixed structural member;

(2) a transverse plate having first and second opposing edges, the transverse plate coupled along the first edge to the base plate and extending generally perpendicular to the base plate;

(3) a mounting plate coupled to the second edge of the transverse plate and extending parallel to and in an opposite direction as the base plate; and (4) a second tubular guard projection being open at each end and secured to and extending from the base plate in the same direction as the transverse plate, the second tubular guard projection being rectangular in cross-section and being configured to extend along the engagement axis when the keeper is secured to the fixed structural member, wherein the second tubular guard projection includes first and second transverse pins extending across the second tubular guard projection in a direction generally perpendicular to the engagement axis, and wherein the first tubular guard projection is sized and configured relative to the second tubular guard projection to substantially overlap the full length of the second tubular guard projection along the engagement axis when the sliding gate is secured to the fixed structural member.

24. A latch assembly for securing a first structural member to a second structural member, wherein one of the first and second structural members is disposed on a slidable partition configured to slide relative to the other structural member along an engagement axis, and the first structural member including a latch member receiving aperture defined in an end surface thereof, and a lock assembly having a latch member extending through the latch member receiving aperture and a lock release accessible from one side of the first structural member to manipulate the latch member, the latch assembly comprising:

(a) a first tubular guard projection configured to be secured to the end surface of the first structural member and to circumscribe the latch member receiving aperture, the first tubular guard projection configured to extend outwardly from the end surface and in a direction generally along the engagement axis when secured to the first structural member; and (b) a keeper configured to be secured to the second structural member, the keeper including:

(1) a base plate configured to extend generally perpendicular to the engagement axis when the keeper is secured to the second structural member;

(2) opposing edges defined on the keeper and separated from one another in a direction generally transverse to the engagement axis, each such edge having a minimum separation from the lock release that is at least about 4⅜ inches when the first structural member is secured to the second structural member; and (3) a second tubular guard projection secured to and extending from the base plate and configured to extend along the engagement axis when the keeper is secured to the second structural member, wherein the first and second tubular guard projections are sized and configured relative to one another to overlap along the engagement axis when the first structural member is secured to the second structural member.

25. The latch assembly of claim 24, wherein each edge of the keeper defines a minimum separation from the lock release that is at least about 5 inches.

26. The latch assembly of claim 24, wherein the keeper further includes:

(a) a transverse plate having first and second opposing edges, the transverse plate coupled along the first edge to the base plate and extending generally perpendicular to the base plate in the same direction as the second tubular guard projection; and (b) a mounting plate coupled to the second edge of the transverse plate and extending parallel to and in an opposite direction as the base plate, wherein the base plate, the transverse plate and the mounting plate each have about the same length in a direction transverse to the engagement axis.

27. The latch assembly of claim 26, wherein the base plate, the transverse plate and the mounting plate each have a length of at least about 12 inches.

28. The latch assembly of claim 24, wherein the opposing edges of the base plate are separated from a centerline of the lock assembly by about the same distance; whereby the keeper is reversible.

* * * * *